United States Patent [19]

Fritts

[11] 3,987,567

[45] Oct. 26, 1976

[54] FLEXIBLE COPY SECTION

[75] Inventor: Robert W. Fritts, Stillwater, Minn.

[73] Assignee: Minnesota Mining and Manufacturing Company, St. Paul, Minn.

[22] Filed: May 7, 1973

[21] Appl. No.: 357,813

Related U.S. Application Data

[63] Continuation of Ser. No. 189,292, Oct. 14, 1971, abandoned.

[52] U.S. Cl. ..... 40/125 F; 35/7 A; 40/142 A

[51] Int. Cl.[2] ..... G09F 7/04

[58] Field of Search ..... 40/125 F, 125 A, 129 C, 40/129 R, 142 A, 135, 125 K; 35/7 A

[56] References Cited

UNITED STATES PATENTS

| | | | |
|---|---|---|---|
| 1,735,883 | 11/1929 | Smith | 40/142 A |
| 3,187,449 | 6/1965 | Longo et al. | 40/142 A X |
| 3,372,503 | 3/1968 | Weeks | 40/129 C X |
| 3,664,910 | 5/1972 | Hollie | 40/135 X |
| 3,716,935 | 2/1973 | Friederichs | 40/142 A |

FOREIGN PATENTS OR APPLICATIONS

| | | | |
|---|---|---|---|
| 237,106 | 3/1962 | Australia | 40/142 A |
| 1,205,043 | 9/1970 | United Kingdom | 40/136 |

OTHER PUBLICATIONS

Charles Mayer Studios Inc., Rubber Magnets Circular, 1960.

Allmag & Rayco, Signs of the Times, Aug. 1971, p. 74.

*Primary Examiner*—John F. Pitrelli

*Attorney, Agent, or Firm*—Alexander, Sell, Steldt & DeLaHunt

[57] ABSTRACT

A laminated flexible copy section comprising a rectangular film-sheet composite maintainable on a metal signboard by flexible magnet strips secured along edges of the sheet. Tabs secured to the upper edge of the section permit the copy section to be readily peeled from the signboard.

5 Claims, 4 Drawing Figures

INVENTOR.
ROBERT W. FRITTS
BY Kinney, Alexander, Sell, Steldt & DeLaHunt
ATTORNEYS.

FLEXIBLE COPY SECTION

This is a continuation of application Ser. No. 189,292 filed Oct. 14, 1971, now abandoned.

FIELD OF THE INVENTION

The present invention relates to rotatable copy sections for signboards.

BACKGROUND OF THE INVENTION

The most common type of signboard copy display utilitizes copy supporting paper pasted to the face of the signboard. Generally, it is not possible to remove such a pasted copy without destroying the paper and the copy. If it is desired to permit removal and relocation of the copy (known in the art as "rotating" the copy) to maximize the use and exposure of the copy, the display is composed of a plurality of separate unitary panels secured to each other and to the signboard to form the display. Each panel is generally constructed of a peripheral metal frame two feet wide and twelve feet high and a copy receiving board spanning the frame. Thus, to form a copy display 12 feet high and 24 feet long, 12 panels are required to complete the display. Rotation of a copy composed of such panels requires a two-man crew and a crane truck to handle the panels.

SUMMARY OF THE INVENTION

The copy section of the present invention is a laminated flexible copy section composed of a flexible sheet, at least two flexible magnet strips secured to the backside of the sheet, a flexible filler pad or pads secured to the backside of the sheet between the strips and a flexible film secured to the front side of the sheet. A plurality of the sections may be butted against each other on the vertical facial surface of a signboard to form a copy display.

The flexible sheet is formed from a thermally dimensionally stable material to provide dimensional rigidity even in hot environments and to maintain distortion free registration between the abutting copy sections. The flexible magnet strips secured along the vertical edges of the sheet and extending between the upper and lower edges of the sheet hold the vertical edges of the section tightly against a magnetically responsive face of a signboard to prevent a horizontally moving wind from getting behind and peeling a section from the signboard. The magnet strips also act to conform each flexible section to the particular facial characteristic of the signboard and to seal the backside of the section from rain or dirt. The flexible filler pad or pads, having the same uniform thickness as the magnet strips, reinforce the section to minimize the deflection of the film toward and away from the signboard caused by changing wind pressure against the front face of the film. The flexible film, secured to the front side of the sheet, provides weather-resistance for and display of indicia. To provide a long-lived copy the indicia may be imprinted into or painted on the flexible film or the flexible film may be transparent with the indicia imprinted into or painted on the thermally dimensionally stable sheet.

Preferrably, one or more tabs are secured to the copy section at one edge thereof to permit the flexible copy section to be readily peeled from the signboard. A roller with projections to engage eyelets in the tabs may be used to peel and roll up each section from the signboard. The rolled up section may then be readily unrolled at a new location. Thus, one person may easily rotate copy displays formed of the copy sections of the present invention without a crane truck.

BRIEF DESCRIPTION OF THE DRAWING

This invention will become better understood by reference to the following description of the preferred embodiment when considered in connection with the accompanying drawing in which like numerals designate like parts throughout the figures and wherein.

DETAILED DESCRIPTION OF THE PREFERRED EMBODIMENT

Figure 1:
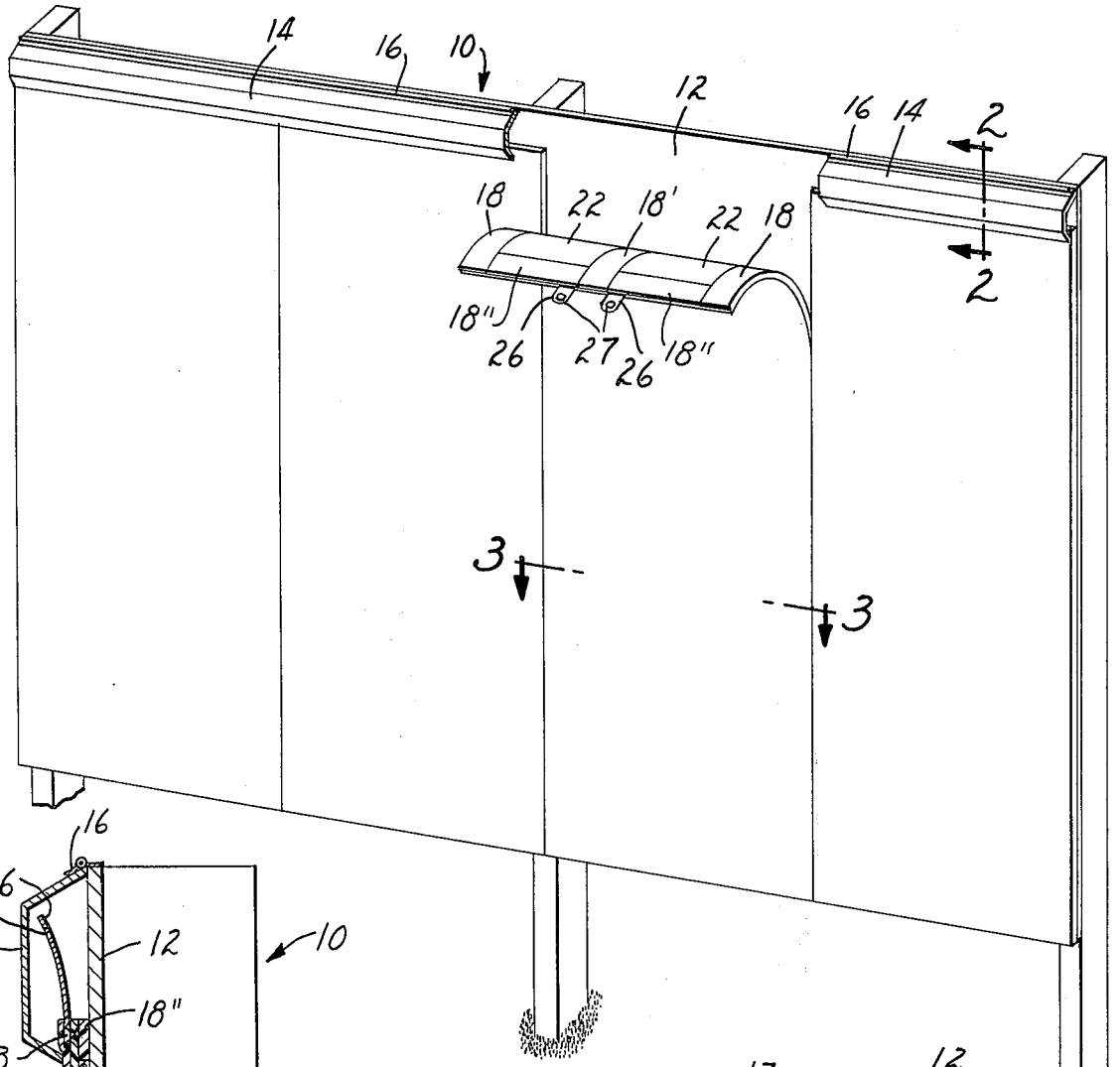
FIG. 1 is a perspective view, partially in section, of four flexible copy sections combined to form a copy display on an outdoor signboard.
Figure 2:
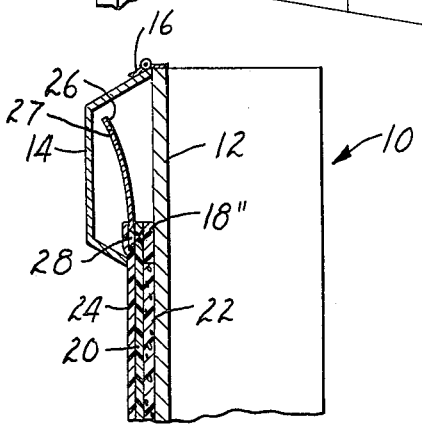
FIG. 2 is a cross-sectional view taken along line 2—2 of FIG. 1.
Figure 4:
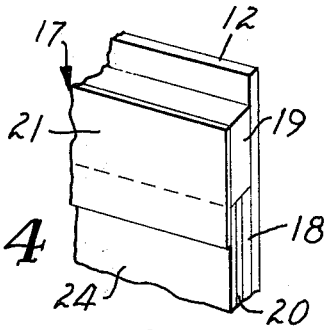
FIG. 4 is a fragmentary perspective view of a second embodiment of a weather cover.

FIG. 1 illustrates an outdoor display 10 comprising a signboard 12 and four flexible copy sections, one of which is partially peeled away from the magnetically responsive face of the signboard 12. At the upper front edge of the signboard is a cover 14, rotatable about a hinge 16 (See FIG. 2), for providing weather and rain protection to the upper edge of the copy sections. In FIG. 4 there is illustrated an alternative embodiment of the weather protective cover comprising a weather strip 17 formed of a flexible magnet 19 having a thickness equal to that of the copy sections and a vinyl strip 21 adhesively secured to the face of the magnet 19 and extending beyond one edge thereof to overlap the upper edge of the copy sections. Strips similar to the weather strip 17 may be placed around the entire periphery of the copy section display to form an esthetic border therefor.

Figure 3:
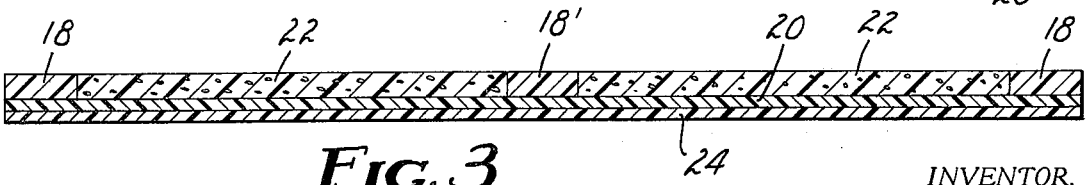
FIG. 3 is a cross-sectional view of a single copy section taken along line 3—3 of FIG. 1.

Each copy section includes a rectangular, substantially flexible, thermally dimensionally stable sheet 20. Suitable materials for the thermally dimensionally stable flexible sheet 20 are for example, acrylonitrilebutadienestyrene (ABS), high impact styrene and butyrate. At least two flexible magnet strips 18 are adhesively secured to the backside of the sheet 20. These flexible magnet strips 18 comprising a high bonding of permanent magnet powder in a flexible non-magnetizable binder, extend along the longitudinal edges of the sheet (see FIGS. 2 and 3) and are coterminal therewith. A magnet strip 18' adhesively secured to the backside of sheet 20, centrally located between the strips 18 and coterminal with the longitudinal edges of the sheet 20, provides additional force for holding the sheet 20 to the signboard 12. The signboard 12 may have a layer of ferromagnetic material, painted to provide a protective coating, to form a face against which the copy sections are placed or, alternatively the face may include spaced strips of the flexible magnetic material disposed to attract the magnetic strips on the copy sections.

A pair of flexible magnet strips 18' are adhesively secured to the sheet 20 to extend laterally between the longitudinal strips 18 and 18', one lateral strip 18'' extending between the central longitudinal strip 18' and an edge longitudinal strip 18. The strips 18'' are located at the upper edge of the copy section (see FIG.

1) to provide additional force for holding the upper edge of the copy section to the signboard 12. Magnet strips similar to strips 18'' could also be located at the bottom edge or periodically along the length of the section to provide additional holding force to maintain the section attached to the signboard.

Flexible foam filler material in the form of pads 22, having the same uniform thickness as the magnet strips 18, 18', 18'' is secured to the backside of the sheet 20, by a suitable adhesive, in all areas between the magnet strips. Plastic tabs 26 with eyelets 27 are secured by rivets 28 to the sheet 20 at the upper edge thereof. The tabs 26 may also be formed as integral extensions of the sheet 20.

A weather resistant, paint receptive film 24 is bonded to the front side of the sheets 20 to provide weather-resistance for and display of indicia. In accordance with the present invention the film 24 may also comprise a weather-resistant, paint receptive, flexible coating sprayed or painted onto the thermally dimensionally stable sheet 20 or the indicia may be imprinted into or painted on the stable sheet 20 with the film 24 comprising a flexible transparent coating.

While it is anticipated that the flexible copy section of the preferred embodiment will have external dimensions approximately 2 feet wide and 12 feet long, corresponding to the size of presently used non-rotatable copy panels, the following example illustrates a small copy display that was constructed in accordance with the present invention. Each of four sections was constructed using two 1 in. wide, 25 in. long and 0.060 in. thick strips of flexible permanent magnet material, such as "Plastiform" magnet strips available from the Minnesota Mining and Manufacturing Co. The magnet strips were bonded with a partially cured rubber based pressure-sensitive adhesive to the backside and along the longitudinal edges of a 6.5 in. wide, 25 in. long and 0.010 in. thick sheet of acrylonitrilebutadienestyrene (ABS) material. A 4.5 in. wide, 25 in. long and 0.0625 in. thick urethane pad was secured to the ABS sheet between the magnet strips with the same pressure-sensitive adhesive. A 6.5 in. wide, 25 in. long and 0.007 in. thick white vinyl film having indicia painted thereon was then thermally bonded to the frontside of the ABS sheet. Finally, the four sections were placed side-by-side on a signboard to form a copy display 26 in. wide and 25 in. high.

I claim:

1. A flexible copy section having particular utility as a component in a rotatable copy display used on a signboard and characterized by having sufficient flexibility to permit it to be simultaneously peeled from the signboard and rolled up for storage and transport and to permit it to be unrolled onto the signboard for display, said copy section comprising:

a rectangular, thermally dimensionally stable, flexible sheet of plastic;

first and second flexible magnet strips secured to the backside of said sheet, disposed one along and coterminal with each longitudinal edge of said sheet;

flexible filler pad means secured to the backside of said sheet in all areas between said magnet strips and having the same uniform thickness as the magnet strips; and a flexible film secured to and coterminal with the front side of said sheet providing weather resistance for and display of indicia.

2. A flexible copy section according to claim 1 including a tab secured to said flexible sheet at one edge thereof to permit said flexible copy section to be readily peeled from a signboard.

3. A flexible copy section according to claim 2 including a third flexible magnet strip secured to the backside of said sheet, spaced between and parallel to said first and second strips and coterminal with the opposite longitudinal edges of said sheet.

4. A flexible copy section according to claim 3 including fourth and fifth flexible magnet strips secured to the backside of said sheet, said fourth strip laterally extending between said first and third strips and said fifth strip laterally extending between said second and third strips.

5. A sign comprising:

a signboard having a magnetically responsive face, a plurality of copy sections disposed in side-by-side relation on said face of said signboard to form a display, each said copy section being characterized by having sufficient flexibility to permit it to be simultaneously peeled from said signboard and rolled up for storage and transport and to permit it to be unrolled onto the signboard for display and comprising:

a rectangular, thermally dimensionally stable, flexible sheet of plastic;

first and second flexible magnet strips secured to the backside of said sheet, disposed one along and coterminal with each longitudinal edge of said sheet;

flexible filler pad means secured to the backside of said sheet in all areas between said magnet strips; and a flexible film secured to and coterminal with the front side of said sheet providing weather resistance for and display of indicia.

* * * * *